US007014490B1

(12) United States Patent
Morikawa et al.

(10) Patent No.: US 7,014,490 B1
(45) Date of Patent: Mar. 21, 2006

(54) USB CONNECTOR EQUIPPED WITH LOCK MECHANISM

(75) Inventors: Taishi Morikawa, Haibara-gun (JP); Tsuyoshi Oshima, Haibara-gun (JP); Nobuyuki Akeda, Haibara-gun (JP); Shinichi Ikemoto, Yokohama (JP); Fumio Narui, Yokohama (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/066,181

(22) Filed: Feb. 25, 2005

(51) Int. Cl.
*H01R 13/627* (2006.01)

(52) U.S. Cl. ..... 439/352; 439/358

(58) Field of Classification Search ..... 439/350–353, 439/357, 358
See application file for complete search history.

(56) References Cited

U.S. PATENT DOCUMENTS 5,011,424 A * 4/1991 Simmons ..... 439/352
5,171,161 A * 12/1992 Kachlic ..... 439/352
5,435,744 A * 7/1995 Derstine et al. ..... 439/352
5,580,268 A * 12/1996 Miyazawa ..... 439/352
5,634,809 A * 6/1997 Hirai ..... 439/352
5,772,461 A * 6/1998 Yu ..... 439/352
6,619,976 B1 * 9/2003 Huetter et al. ..... 439/352
6,902,432 B1 * 6/2005 Morikawa et al. ..... 439/358

FOREIGN PATENT DOCUMENTS

JP 2001-135413 A 5/2001

* cited by examiner

*Primary Examiner*—Tho D. Ta
(74) *Attorney, Agent, or Firm*—Sughrue Mion, PLLC

(57) ABSTRACT

A USB connector includes a receptacle which includes a receptacle shell and a receptacle terminal; a plug which includes a plug shell for fitting into the receptacle shell and a plug terminal; and an engagement release member which is provided on the plug shell so as to be movable between an engagement releasing position and an engagement position. When the plug is fitted into the receptacle, the plug terminal is electrically connected to the receptacle terminal. The plug shell has a retaining portion. The receptacle shell has an engagement portion which is engaged with the retaining portion when the plug is fitted into the receptacle. The engagement release member maintains an engagement of the retaining portion with the engagement portion at the engagement position. The engagement release member releases the engagement of the retaining portion with the engagement portion at the engagement releasing position.

7 Claims, 12 Drawing Sheets

USB CONNECTOR EQUIPPED WITH LOCK MECHANISM

BACKGROUND OF THE INVENTION

This invention relates to a USB (Universal Serial Bus) connector with a lock mechanism, and more particularly to a lock mechanism-equipped USB connector for electrically connecting a body of a computer (such as a personal computer and a work station) to a peripheral equipment such as a mouse and a keyboard.

Generally, a computer body and a peripheral equipment are electrically connected together by a USB interface. In recent years, a computer has been required to be also connected to a small-size equipment such as a digital camera and a portable audio player, and therefore Mini-B interfaces of a small-size have now been adopted, and USB connectors for use with this interface have now been marketed.

In a USB connector, when a plug is inserted into a receptacle, plug terminals is electrically connected to receptacle terminals, respectively. A related USB connector is not provided with a mechanism for preventing the withdrawal of the connector, and a mountain-shaped lock piece, provided at a receptacle shell, is adapted to be engaged in a hole formed in a receptacle shell. Therefore, the retaining force is low, and therefore there has been a fear that the engagement is released upon application of vibration or an external force to the plug or the receptacle.

To solve the above problem, there has been proposed a connector withdrawal prevention mechanism for preventing the withdrawal of a plug from a receptacle by the use of a cap (see, for example, JP-A-2001-135413 (Pages 3 to 4, FIG. 1)).

FIG. 20 is a perspective view of a connector withdrawal prevention mechanism disclosed in JP-A-2001-135413. In the connector withdrawal prevention mechanism 1, a plug 3 is fitted into a resin-molded cap 2 to be received therein, and claws 2*a* which are formed on the cap 2 are engaged in a hole 5*a* formed in a box-like body 5, thereby fixing the cap 2 so as to prevent the plug 3 from being withdrawn from a receptacle 4, as shown in FIG. 20.

However, when vibration or an external force is applied to a related USB connector not provided with the above connector withdrawal prevention mechanism, and the connector is easily withdrawn, which has invited a problem that the transmission of data is interrupted when a computer is being used. In apparatuses such as a computer and a game player in which a peripheral equipment, when in use, is moved, an external force or vibration is applied to a USB connector, and this has been a big problem.

Although the connector withdrawal prevention mechanism 1, disclosed in JP-A-2001-135413, has the connector withdrawal prevention function, the plug 3 is adapted to be received within the cap 2, and therefore the cap 2 is rather large in size, and therefore there has been encountered a problem that this structure does not sufficiently meet a requirement for a small-size design of the apparatus which has been increasingly desired in recent years.

And besides, after the plug 3 is fitted in the cap 2, the claws 2*a* of the cap 2 are engaged in the hole 5*a* in the body-like body 5, and therefore each time the plug 3 is engaged with or disengaged from the receptacle 4, the cap 2 must be engaged in the hole 5*a* in the box-like body 5, or the engagement must be released, and therefore there has been mom for improvement with respect to the operability.

SUMMARY OF THE INVENTION

This invention has been made in view of the above problems, and an object of the invention is to provide a USB connector equipped with a lock mechanism, in which a plug and a receptacle which are engaged with each other will not become loose to be withdrawn from each other even upon application of vibration or an external force, and also the connector is high in reliability, and is excellent in operability so that the engagement of the plug with the receptacle can be easily effected and released.

In order to achieve the above object, according to the present invention, there is provided a USB connector, comprising:

- a receptacle which includes a receptacle shell, and a receptacle terminal provided in the receptacle shell;
- a plug which includes a plug shell for fitting into the receptacle shell, and a plug terminal provided in the plug shell; and
- an engagement release member which is provided on the plug shell so as to be movable between an engagement releasing position and an engagement position,
- wherein when the plug is fitted into the receptacle, the plug terminal is electrically connected to the receptacle terminal;
- wherein the plug shell has a retaining portion;
- wherein the receptacle shell has an engagement portion which is engaged with the retaining portion when the plug is fitted into the receptacle;
- wherein the engagement release member maintains an engagement of the retaining portion with the engagement portion at the engagement position; and
- wherein the engagement release member releases the engagement of the retaining portion with the engagement portion at the engagement releasing position.

Preferably, the engagement release member presses the retaining portion to release the engagement of the retaining portion with the engagement portion at the engagement releasing position. The engagement release member allows the retaining portion to project from the plug shell at the engagement position.

In the USB connector of the above construction, the retaining portion is provided at the plug shell, and the engagement portion is provided at the receptacle shelf, and when the plug is inserted into the receptacle, the retaining portion is engaged with the engagement portion. Therefore, the plug and the receptacle are engaged with each other without looseness, and even when vibration or an external force acts on the connector, the plug is prevented from being withdrawn from the receptacle. Therefore, the reliability of the lock mechanism-equipped USB connector is enhanced.

The retaining portion is formed integrally with the plug shell, and the engagement portion is formed integrally with the receptacle, and therefore the retaining mechanism can be formed into a small size, and this construction can sufficiently meet a demand for a small-size design of the equipment.

And besides, by inserting the plug into the receptacle, the retaining portion is brought into engagement with the engagement portion, and by moving the engagement release mechanism from the engaging position to the engagement releasing position, the engagement release mechanism presses the retaining portion, thereby releasing the engagement of the retaining portion with the engagement portion. Therefore, the plug and the receptacle can be quite easily engaged with each other, and also this engagement can be quite easily released, thus greatly enhancing the operability.

Preferably, the retaining portion is a resilient piece portion formed at a wall portion of the plug shell. The resilient piece portion has a claw formed at a distal end thereof. The engagement portion is a hole formed in the receptacle shell.

In the lock mechanism-equipped USB connector of the above construction, the retaining portion is the resilient piece portion formed at the wall portion of the plug shell, and the engagement portion is the hole formed in the receptacle shell, with this construction, the plug and the receptacle can be positively and easily engaged with and disengaged from each other by a small device without the need for using a large special part as used in the conventional construction.

Preferably, the receptacle terminal is contained in an inner receptacle shell provided in the receptacle shell. The plug terminals is contained in an inner plug shell provided in the plug shell.

In the lock mechanism-equipped USB connector of the above construction, the receptacle terminals are received within the inner receptacle shell provided within the receptacle shell, and the plug terminals are received within the inner plug shell provided within the plug shell, and therefore the receptacle terminals as well as the plug terminals are protected by the double-shell structure, and the connection of high reliability can be achieved. When each shell is made of an electrically-conductive material, the terminals can be electromagnetically shielded by the double-shell structure, and the reliability of protection against external noises can be enhanced. And besides, the receptacle and the plug are fitted and connected together in such a double manner that the receptacle shell and the plug shell (which are the outer shells) are fitted together, while the inner receptacle shell and the inner plug shell (which are the inner shells) are fitted together. Therefore, even when an external force, such as a twisting force, is applied to the lock mechanism-equipped USB connector, the connected condition will not be adversely affected by it, and therefore can be properly maintained.

Preferably, the engagement release member includes a slide member which is provided on the plug shell so as to slide in a fitting direction of the plug into the receptacle. The slide member is movable between the engagement releasing position where the slide member presses the retaining portion to hold the retaining portion within the plug shell and the engagement releasing position where the slide member allows the retaining portion to project from the plug shell through the engagement portion.

Preferably, the engagement release member includes a pressing member which is provided on the plug shell so as to move in a direction substantially perpendicular to a fitting direction of the plug into the receptacle. The pressing member is movable between the engagement releasing position where the pressing member presses the retaining portion to hold the retaining portion within the plug shell and the engagement releasing position where the pressing member allows the retaining portion to project from the plug shell through the engagement portion.

In the lock mechanism-equipped USB connector of the above construction, the engagement release mechanism is either the slide member which is fitted on the plug shell so as to slide in the direction of fitting of the plug into the receptacle, and is movable between the engagement releasing position where the slide member presses the retaining portion to hold the retaining portion within the plug shell and the engagement releasing position where the slide member allows the retaining portion to project from the plug shell, or the pressing member which is mounted on the plug shell so as to move in the direction generally perpendicular to the direction of fitting of the plug into the receptacle, and is movable between the engagement releasing position where the pressing member presses the retaining portion to hold the retaining portion within the plug shell and the engagement releasing position where the pressing member allows the retaining portion to project from the plug shell. Therefore, merely by effecting either the simple operation for moving the slide member from the engaging position to the engagement releasing position or the simple operation for moving the pressing member from the engaging position to the engagement releasing position, the engagement of the retaining portion with the engagement portion can be easily canceled, and the operability for connection and disconnection of the lock mechanism-quipped USB connector can be greatly enhanced.

Preferably, the engagement release member has an urging portion which urges the engagement release member with respect to the plug shell so as to move the engagement release member to the engagement position. When the plug is released from the receptacle, the engagement release member moves to the engagement releasing position against an urging forth by the urging portion.

Preferably, a movement direction of the engagement release member to the engagement releasing position is substantially same as a releasing direction of the plug from the receptacle.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Preferred embodiments of a lock mechanism-equipped USB connector of the present invention will now be described in detail with reference to the drawings.

First Embodiment

Figure 1:
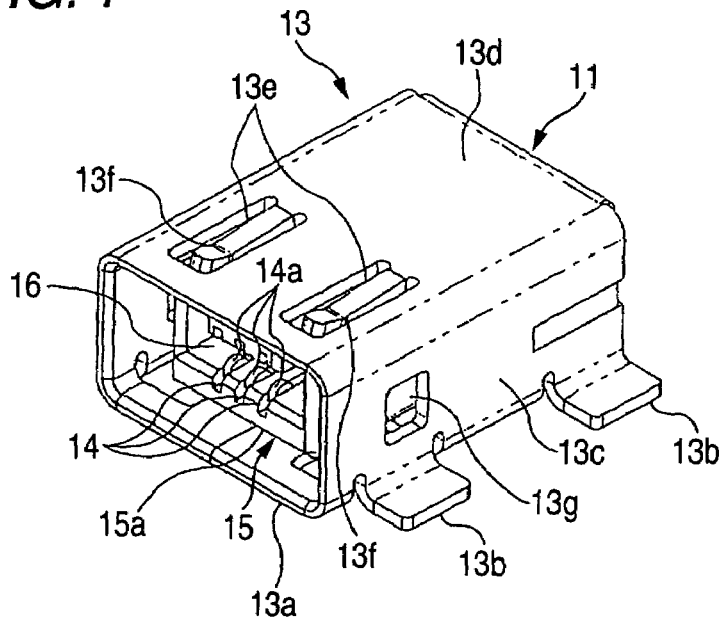
FIG. 1 is a perspective view of a receptacle of a lock mechanism-equipped USB connector according to a first embodiment of the invention.
Figure 2:
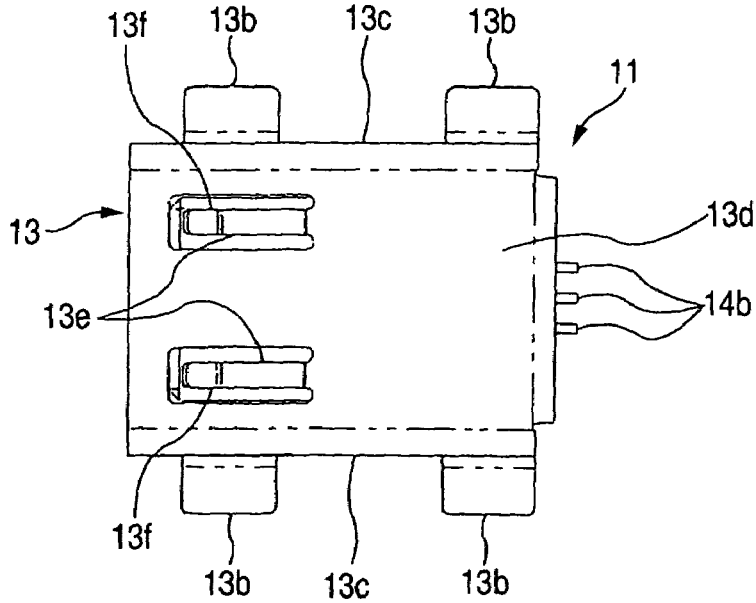
FIG. 2 is a plan view of the receptacle of FIG. 1.
Figure 3:
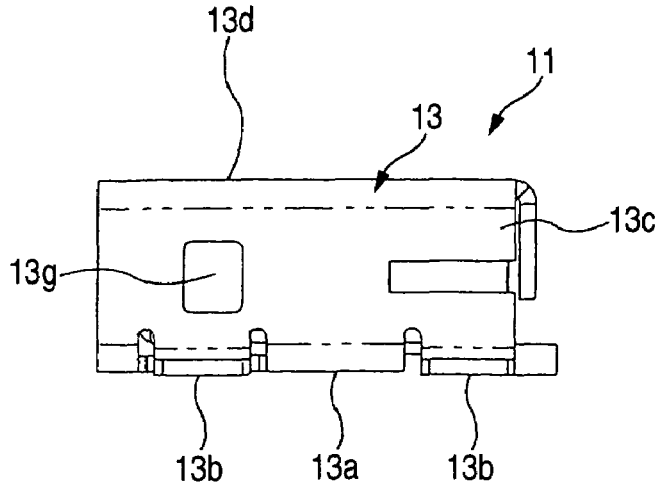
FIG. 3 is a side-elevational view of the receptacle of FIG. 1.

FIG. 1 is a perspective view of a receptacle of the lock mechanism-equipped USB connector of the first embodiment, FIG. 2 is a plan view of the receptacle of FIG. 1, and FIG. 3 is a side-elevational view of the receptacle of FIG. 1.

Figure 4:
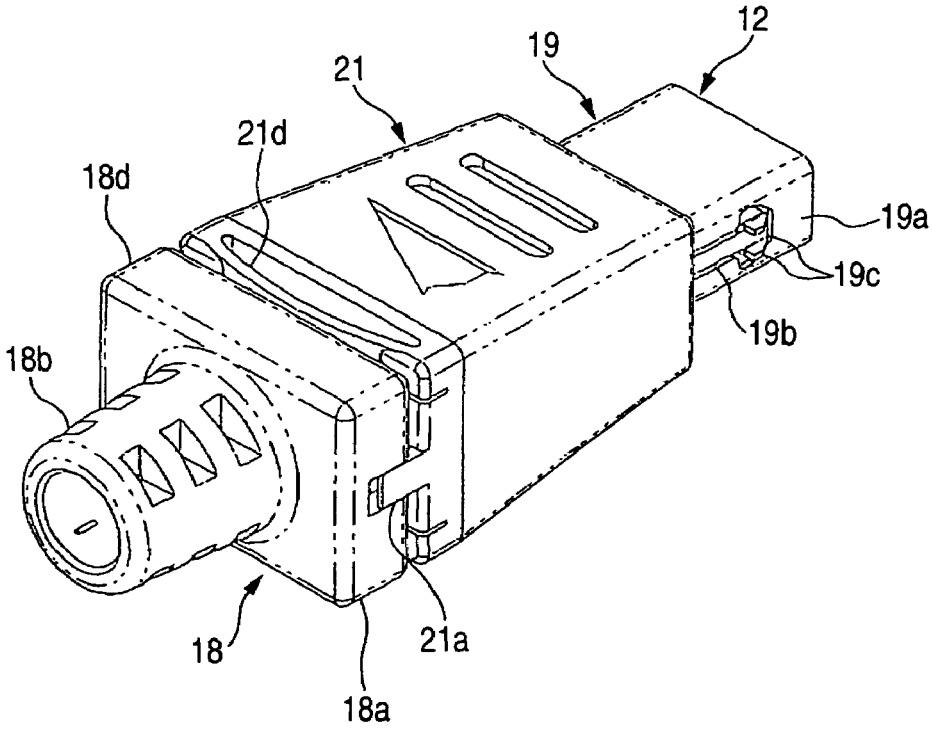
FIG. 4 is a perspective view of a plug of the lock mechanism-equipped USB connector of the first embodiment.
Figure 5:
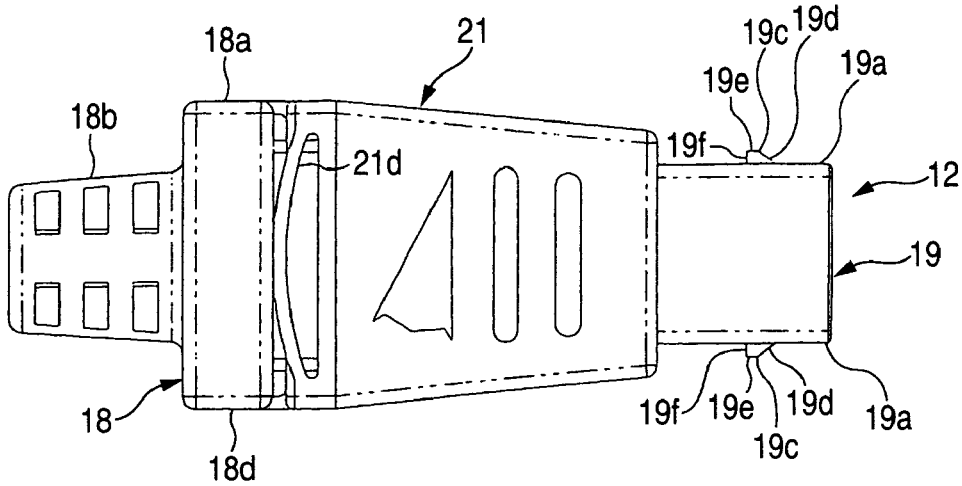
FIG. 5 is a plan view of the plug of FIG. 4.
Figure 6:
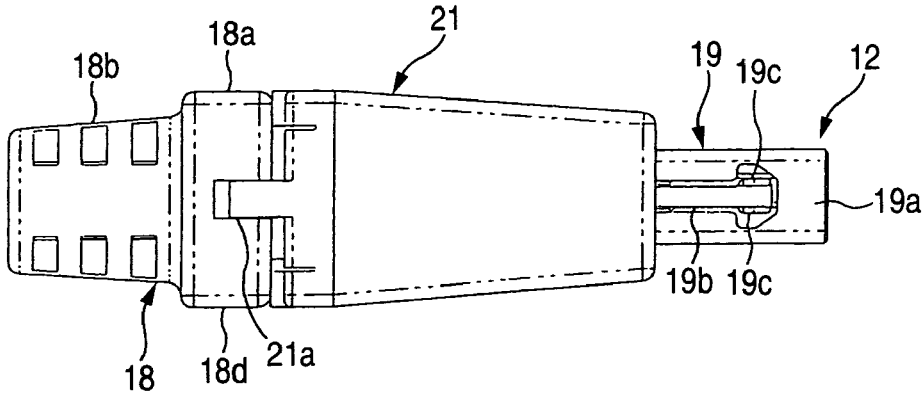
FIG. 6 is a side-elevational view of the plug of FIG. 4.

FIG. 4 is a perspective view of a plug of the lock mechanism-equipped USB connector of the first embodiment, FIG. 5 is a plan view of the plug of FIG. 4, and FIG. 6 is a side-elevational view of the plug of FIG. 4.

Figure 7:
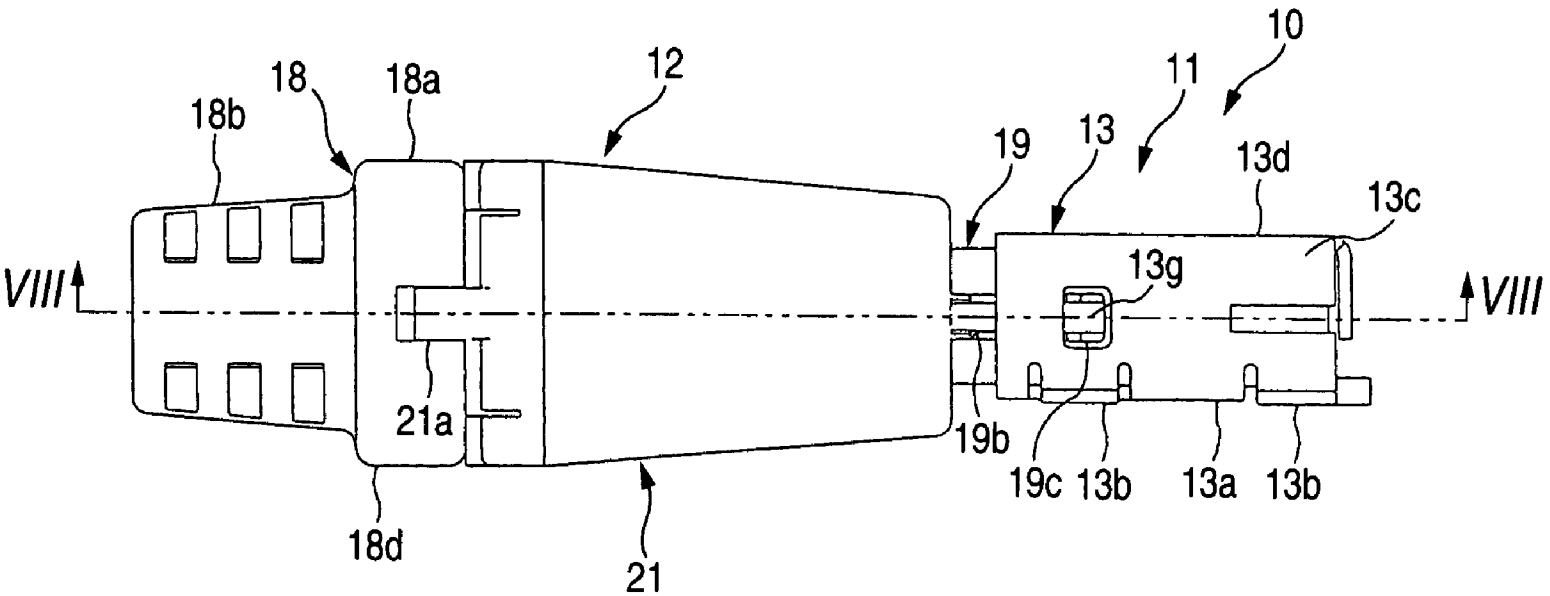
FIG. 7 is a side-elevational view of the lock mechanism-equipped USB connector of the invention, showing a condition in which the plug is inserted in the receptacle.
Figure 8:
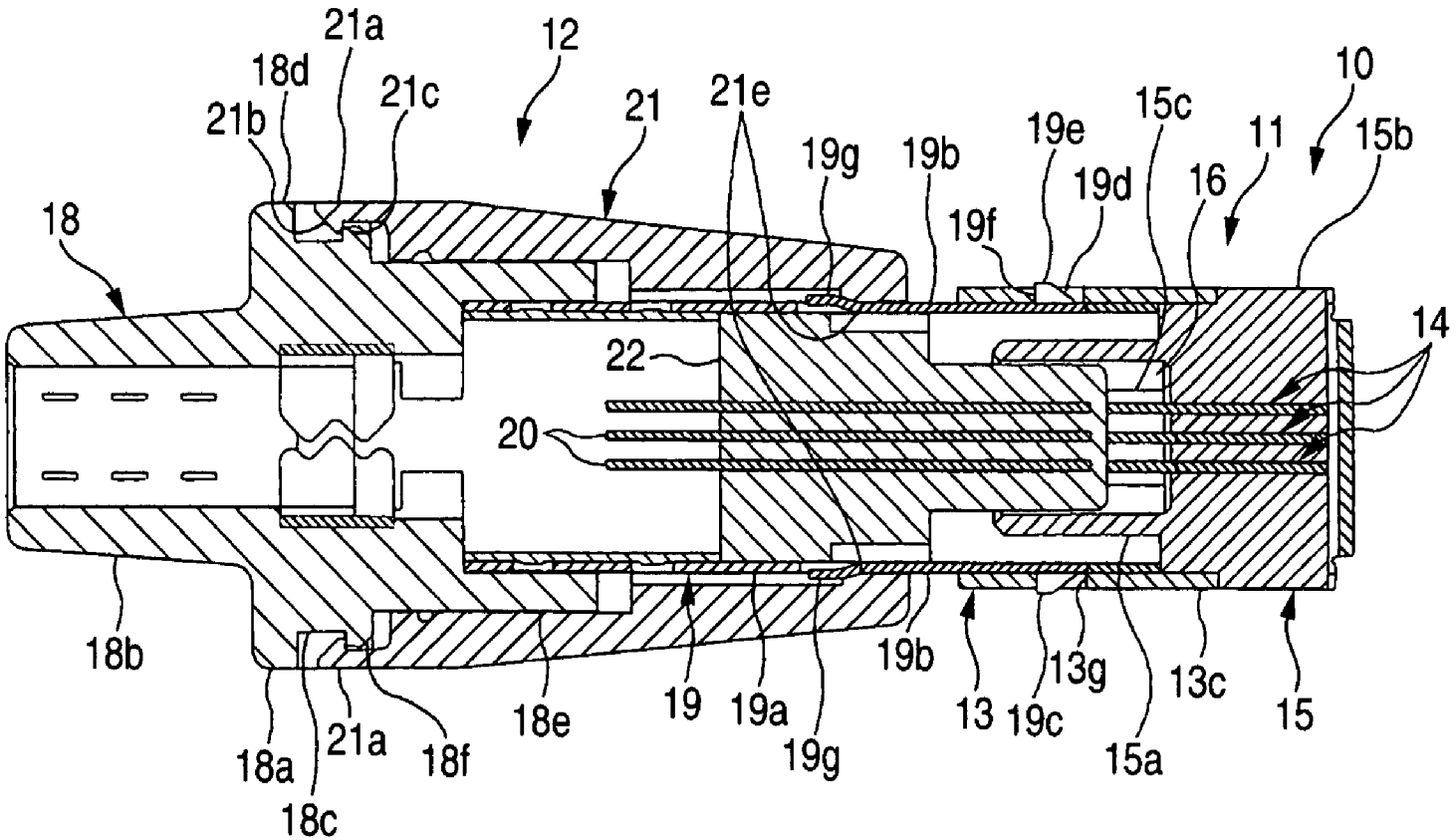
FIG. 8 is a cross-sectional view taken along the line VIII—VIII of FIG. 7, showing a condition in which retaining portions of the plug are engaged in engagement portions of the receptacle.
Figure 9:
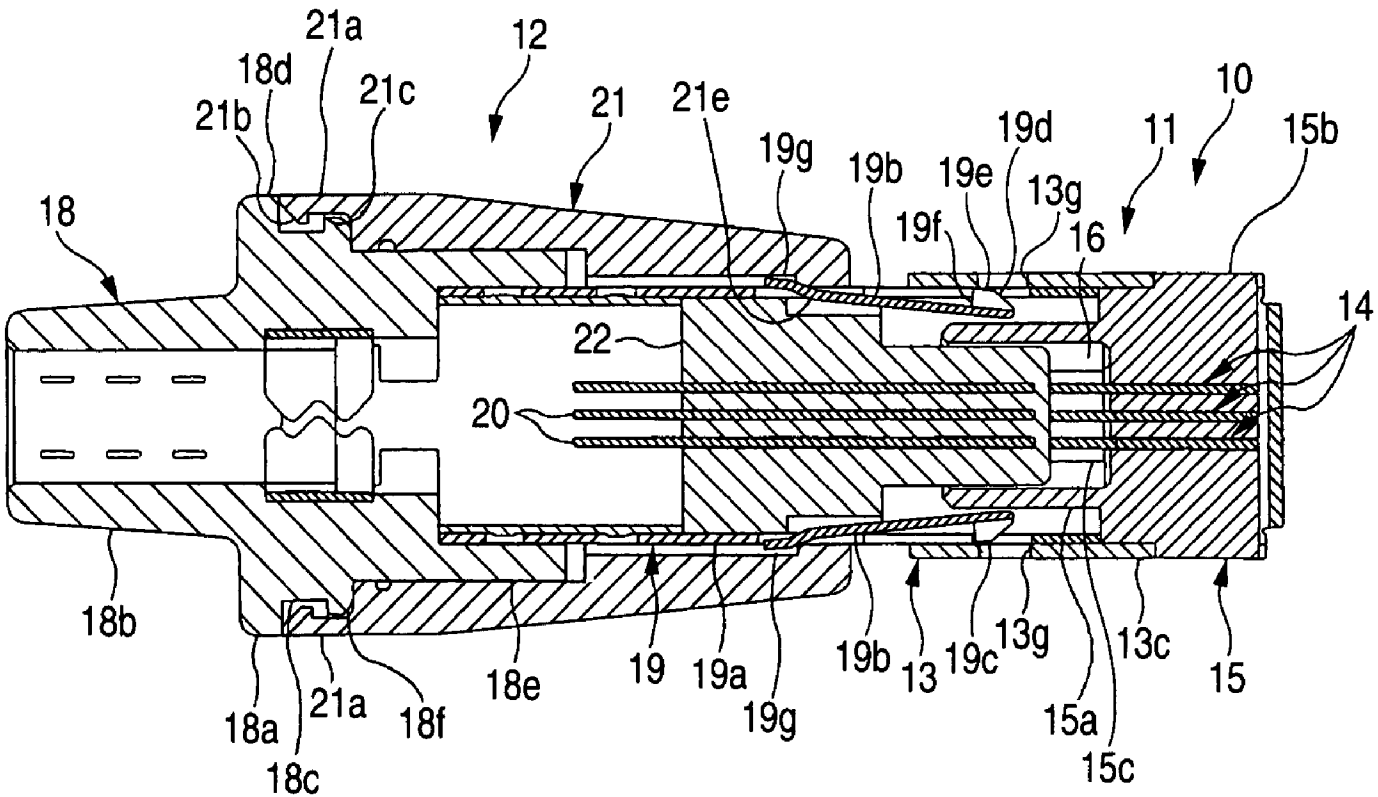
FIG. 9 is a cross-sectional view taken along the line VIII—VIII of FIG. 7, showing a condition in which the retaining portions are pressed by a slide member, and are disengaged from the engagement portions.

FIG. 7 is a side-elevational view of the lock mechanism-equipped USB connector of the invention, showing a condition in which the plug is inserted in the receptacle, FIG. 8 is a cross-sectional view taken along the line VIII—VIII of FIG. 7, showing a condition in which retaining portions of the plug are engaged in engagement portions of the receptacle, and FIG. 9 is a cross-sectional view similar to FIG. 8, showing a condition in which the retaining portions are pressed by a slide member, and are disengaged from the engagement portions.

As shown in FIGS. 1 to 6, the lock mechanism-equipped USB connector 10 of the first embodiment includes the receptacle 11 and the plug 12. This connector 10 is used mainly for connecting an on-vehicle computer body to a peripheral equipment.

As shown in FIGS. 1 to 3, the receptacle 11 includes a receptacle shell 13 and receptacle terminals 14 provided within the receptacle shell 13. The receptacle shell 13 is formed by pressing an electrically-conductive thin sheet (made of copper, a copper alloy, an aluminum alloy or the like) into a generally rectangular tubular shape.

In use, the receptacle shell 13 is fixed to a circuit board (not shown) by soldering, brazing or the like. This receptacle shell 13 includes a lower wall 13*a* for abutting against the circuit board, and opposite side walls 13*c* extending upwardly perpendicularly from the lower wall 13*a*. Two mounting legs 13*b* extend laterally from each of the opposite side walls 13*c*. The receptacle shell 13 is adapted to be fixedly secured to the circuit board through the four mounting legs 13*b* fixed thereto by soldering, brazing or the like.

Cantilever-like shielding contact piece portions 13*e* are provided at an upper wall 12*d* disposed in opposed relation to the lower wall 13*a*, and extend forwardly in a direction (hereinafter referred to as "connector fitting direction") of fitting of the receptacle 11 and the plug 12. Each shielding contact piece portion 13*e* of a cantilever shape is formed as a result of forming a generally U-shaped groove (which define three sides of this contact piece portion 13*e*) through the upper wall by stamping such that the contact piece portion 13*e* is connected to the upper wall 13*d* at its rear end in the connector fitting direction. A distal end portion of each contact piece portion 13*e* is bent toward the inside of the receptacle shell 13 to form a curved portion 13*f*.

A hole 13*g*, serving as the engagement portion, is formed through that portion of each side wall 13*c* which is to be opposed to the corresponding retaining portions 19*c* of a plug shell 19 (described later), the hole 13*b* being adapted to be engaged with the retaining portions 19*c*. A resin portion 15, formed by injection molding of an insulative resin such as propylene, is provided within the receptacle shell 13.

The resin portion 15 includes a frame portion 15*a* of a generally rectangular tubular shape having a fitting hole 16 open forwardly in the connector fitting direction, and a body portion 15*b*. The body portion 15*b* has one end portion 15*c* projecting into the frame portion 15*a*, and also has a plurality of through holes which extend in the connecting fitting direction, and communicate with the fitting hole 16. Receptacle terminals 14 are inserted respectively in the through holes, and are fixed thereto. The frame portion 15*a* and the body portion 15*b* may be separate from each other, in which case the frame portion 15*a* is formed by pressing an electrically-conductive thin sheet (made of copper, a copper alloy, an aluminum alloy or the like) into a generally rectangular tubular shape, and the body portion 15*b* made of a synthetic resin is received within this frame portion 15*a*. The frame portion 15*a* serves as an inner receptacle shell.

A front end portion of each of the receptacle terminals 14 is bent to form a resilient contact portion 14*a*, and is disposed in the fitting hole 16 in an exposed manner. A rear end portion of each receptacle terminal 14 is bent into a crank-like shape to form a direct-connecting external terminal portion 14*b* which extends rearwardly beyond the receptacle shell 13 so as to be electrically connected to a wiring pattern on the circuit board.

As shown in FIGS. 4 to 6, the plug 12 includes a housing 18 made of a resin, the plug shell 19 held in the housing 18, plug terminals 20 provided within the plug shell 19, and the slide member 21 which is one example of an engagement release mechanism.

As shown in FIG. 8, the housing 18 includes a housing body 18*a* and a tube portion 18*b* for passing wires (not shown) therethrough, and this housing 18 is molded into an integral construction, using an insulative synthetic resin. The housing body 18*a* includes a flange portion 18*d* formed in continuous relation to the tube portion 18*b*, and a smaller-tube portion 18*e* extending from the flange portion 18*d*.

One end portion of the plug shell 19 is fitted in the smaller-tube portion 18*e* in a fixed manner. As shown in FIGS. 4 and 8, a notch of a generally U-shaped contour is formed in each of opposite side surfaces of the flange portion 18*d*, and is disposed generally centrally of the height of the flange portion 18*d*. These notches define engagement grooves 18*c* for engagement respectively with engagement projections 21*a* of the slide member 21 (described later).

The plug shell 19 is formed by pressing an electrically-conductive thin sheet (made of copper, a copper alloy, an aluminum alloy or the like) into a generally rectangular tubular shape. The outer size of the plug shell 19 is slightly smaller than the inner size of the receptacle shell 13 so that the plug shell 19 can be fitted into the receptacle shell 13.

As shown in FIGS. 6 and 8, a pair of resilient piece portions 19*b* are formed respectively at opposite side walls 19*a* of the plug shell 19, and extend forwardly in the connector fitting direction. Each resilient piece portion 19*b* is continuous at its proximal end with the plug shell 19, and is formed into a narrow elongate shape, and extends in the longitudinal direction of the plug shell 19, and is resilient.

A rear end portion of each resilient piece portion 19*b* is projected laterally from the plug shell 19 to provide a pressing portion 19*g*. A pair of claws 19*c*, serving as the retaining portions, are formed at a distal end of the resilient piece portion 19*b*, and project outwardly from the side wall 19*a*. The resilient piece portion 19*b* can be resiliently deformed, and therefore the claws 19*c* are retractably projected from the side wall 19*a* to be engaged in the corresponding hole 13*g* in the receptacle shell 13.

As shown in FIG. 5, each claw 19*c* includes a slanting surface 19*d* gradually approaching the side wall 19*a* forwardly in the connector fitting direction, an interconnecting surface 19*e* extending from the slanting surface 19*d* in the connector fitting direction, and a retaining surface 19*f* substantially perpendicularly intersecting the interconnecting surface 19*e*.

As shown in FIG. 8, the plug terminals 20 are adapted to be contacted respectively with the receptacle terminals 14 to be electrically connected thereto. The plurality of plug terminals 20 are held in a terminal holding portion 22, and are disposed so as to correspond respectively to the resilient contact portions 14*a* of the receptacle terminals 14. The terminal holding portion 22 is formed by injection molding of an insulative synthetic resin such as polypropylene, and is fixedly mounted within the plug shell 19. A distal end portion of the terminal holding portion 22 is identical in shape to the fitting hole 16 in the resin portion 15, and can be inserted into the fitting hole 16.

Although the terminal holding portion 22, illustrated in the drawings, is formed into an integral construction, using the synthetic resin, the terminal holding portion 22 may be modified into a construction in which a frame (which is formed by pressing an electrically-conductive thin sheet (made of copper, a copper alloy, an aluminum alloy or the like) into a generally rectangular tubular shape) is provided to surround an outer peripheral surface (i.e., four side surfaces except front and rear surfaces in the connector fitting direction) of a synthetic resin-made holding portion holding the plug terminals 20. In this case, the generally rectangular tubular frame serves also as an inner plug shell.

An electrical contact portion is formed at the distal end of each plug terminal 20, and when the plug 12 is inserted into the receptacle 11, these electrical contact portions of the plug terminals 20 contact the resilient contact portions 14*a* of the receptacle terminals 14, respectively. An electrical connection portion is formed at the rear end of each plug terminal 20, and the wires are connected respectively to these electrical connection portions by a suitable method such as press-contacting, press-crimping and welding.

As shown in FIGS. 4 and 8, the slide member 21 (which is one example of the engagement release mechanism) can press the resilient piece portions 19*b* so as to cancel the engagement of the claws 19*c* with the holes 13*g*. The slide member 21 is molded of a synthetic resin by injection molding. The slide member 21 is fitted on the smaller-tube portion 18*e* of the housing body 18*a*, and can slide in the connector fitting direction. The pair of opposed engagement projections 21*a* are formed respectively at opposite side walls of the slide member 21, and extend rearwardly, and an inwardly-directed claw is formed at a distal end of each engagement projection 21*a*.

The claw of each engagement projection 21*a* includes a slanting surface 21*b* extending gradually outwardly rearwardly in the connector fitting direction, and a retaining surface 21*c* substantially perpendicularly intersecting the slanting surface 21*b*. The retaining surface 21*c* is engaged with a projection 18*f* defining one side surface of the engagement groove 18*c*. The length of each claw of the slide member 21 is smaller than the width of the engagement groove 18*c* so that the claw can move in the engagement groove 18*c* in accordance with the movement of the slide member 21 in the connector fitting direction.

As shown in FIG. 5, rearwardly-bulging arch portions 21 of a bow-shape are formed respectively at upper and lower walls of the slide member 21 at a rear end portion thereof, and these arch portions 21 are abutted against the flange portion 18*d* of the housing body 18. The slide member 21 is urged forwardly in the connector fitting direction by resilient forces of the arch portions 21*d*.

As shown in FIG. 8, pressing projections 21*e* are formed at the slide member 21, and are disposed to correspond respectively to the pressing portions 19*g* of the resilient piece portions 19*b*. When the slide member 21 is urged forwardly in the connector fitting direction by the resilient forces of the arch portions 21*d* to be located in an engaging position, the pressing projections 21*e* are spaced from the pressing portions 19*g*, respectively. Therefore, each of the resilient piece portions 19*b* is not pressed, and the claws 19*c* are projected from the side wall 19*a*, and are engaged in the hole 13*g*.

When the slide member 21 is urged rearwardly in the connector fitting direction against the resilient forces of the arch portions 21*d* to be located in an engagement releasing position as shown in FIG. 9, the pressing portions 19*g* are pressed by the pressing projections 21*e*, so that the resilient piece portions 19*b* are resiliently deformed or bent toward the inside of the plug shell 19. As a result the claws 19*c* are retracted into the plug shell 19, so that the engagement of the claws 19*c* with the holes 13*g* is canceled.

The operation of the lock mechanism-equipped USB connector of the first embodiment will be described.

In FIG. 8, when the plug shell 19 of the plug 12 is fitted into the receptacle shell 13 of the receptacle 11, and the two are moved toward each other, first, an inner edge of the front end of the receptacle shell 13 is brought into abutting engagement with the slanting surfaces 19*d* of the claws 19*c*.

When the plug 12 is further inserted, the resilient piece portions 19*b* are resiliently deformed toward the inside of the plug shell 19, so that the claws 19*c* are retracted into the plug shell 19.

Each pair of claws 19*c* advance with their interconnecting surfaces 19*e* held in sliding contact with the inner surface of the receptacle shell 13, and reach a position where the claws 19*c* are opposed to the corresponding hole 13*g*. Each resilient piece portion 19*b* is resiliently restored into its original condition, and the claws 19*c* are engaged in the hole 13*g*, with the retaining surfaces 19*f* held against the edge of the hole 13*g*, so that the receptacle 11 and the plug 12 are positively connected together.

At this time, the resilient contact portions 14*a* of the receptacle terminals 14 contact the electrical contact portions of the plug terminals 20, respectively, and therefore are electrically connected thereto.

Also, the curved portions 13*f*, formed respectively at the shielding contact piece portions 13*e* of the receptacle shell 13, are held in contact with the upper wall of the plug shell 19. Therefore, the receptacle terminals 14 and the plug terminals 20 are shielded by the receptacle shell 13 and the plug shell 19, and are protected from external effects such as electromagnetic noises.

When the plug 12 is withdrawn from the receptacle 11, the slide member 21 is held with the hand, and is moved in a direction away from the receptacle 11 as shown in FIG. 9. Therefore, when the slide member 21 is moved from the engaging position to the engagement releasing position, the pressing projections 21*e* press the pressing portions 19*g*, respectively, thereby resiliently deforming or bending the resilient piece portions 19*b* toward the inside of the plug shell 19.

When the claws 19*c* are retracted into the plug shell 19, the engagement of the claws 19*c* with the holes 13*g* is canceled. In this engagement-canceled condition, when the plug 12 is pulled, the plug 12 is moved apart from the receptacle 11, so that the connected condition is canceled.

The direction of movement of the slide member 21 so as to cancel the engagement of the claws 19*c* with the holes 13*g* is the same as the direction of withdrawal of the plug 12 from the receptacle 11, and therefore the plug 12 can be easily withdrawn from the receptacle 11 with one action.

Second Embodiment

Figure 10:
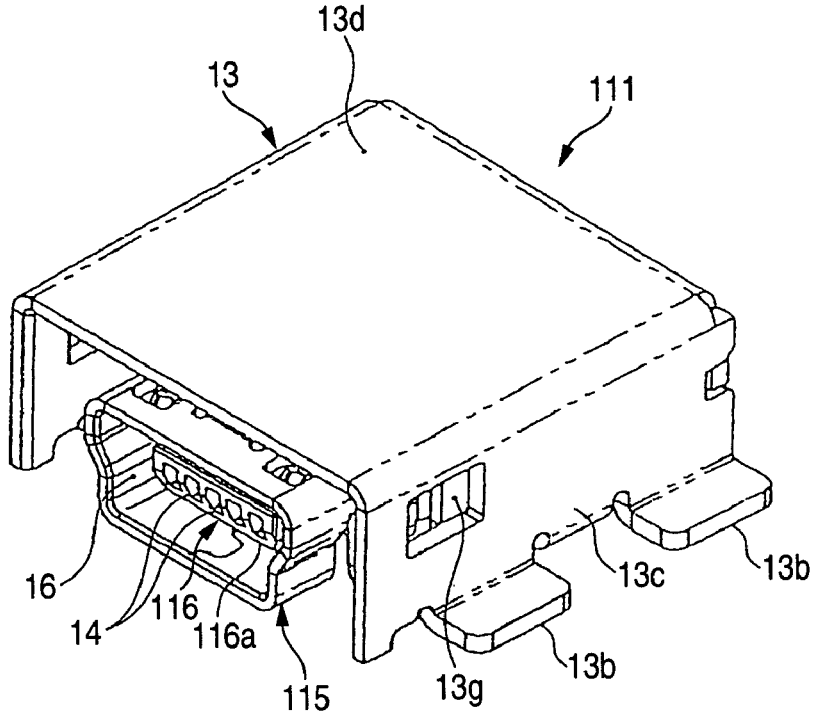
FIG. 10 is a perspective view of a receptacle of a lock mechanism-equipped USB connector according to a second embodiment of the invention.
Figure 11:
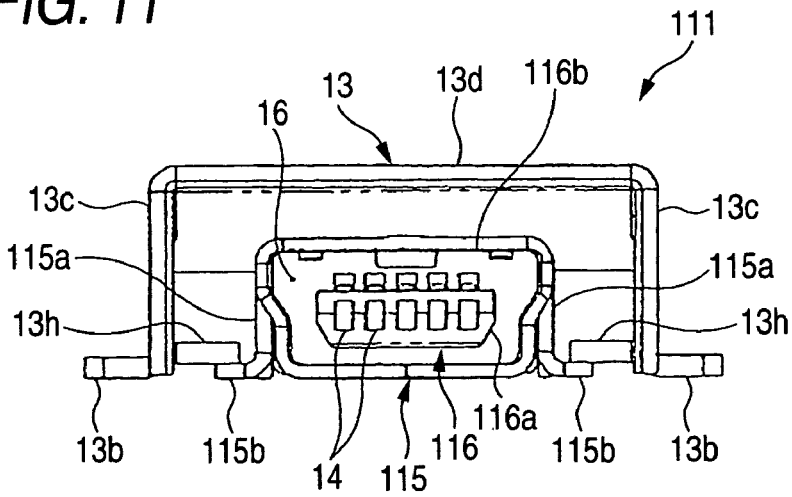
FIG. 11 is a front-elevational view of the receptacle of FIG. 10.
Figure 12:
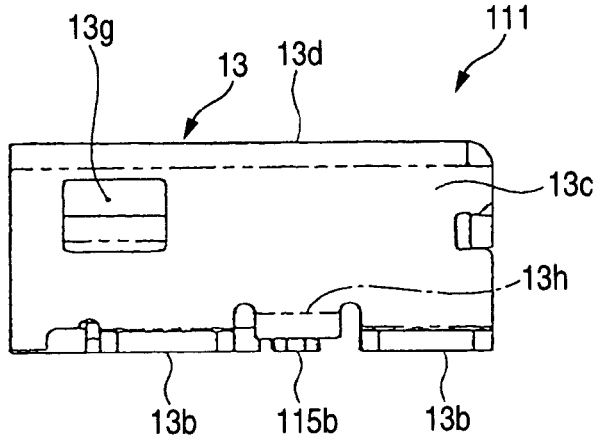
FIG. 12 is a side-elevational view of the receptacle of FIG, 10.

Next, a second embodiment of a lock mechanism-equipped USB connector of the invention will be described with reference to FIGS. 10 to 19. FIG. 10 is a perspective view of a receptacle of the lock mechanism-equipped USB connector of the second embodiment, FIG. 11 is a front-elevational view of the receptacle of FIG. 10, and FIG. 12 is a side-elevational view of the receptacle of FIG. 10.

Figure 13:
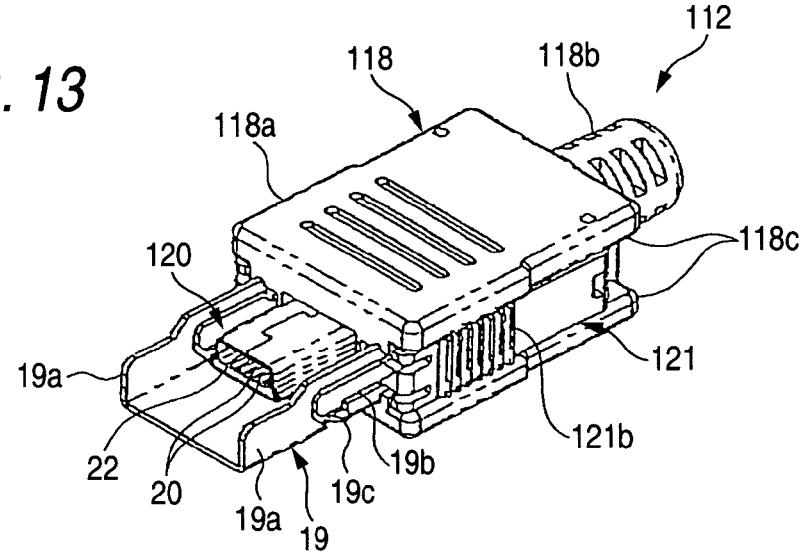
FIG. 13 is a perspective view of a plug of the lock mechanism-equipped USB connector of the second embodiment disposed upside down.
Figure 14:
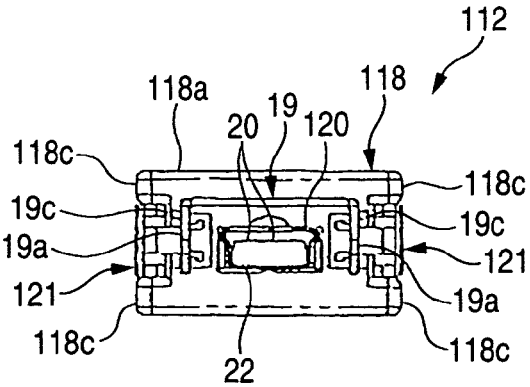
FIG. 14 is a front-elevational view of the plug of FIG. 13.
Figure 15:
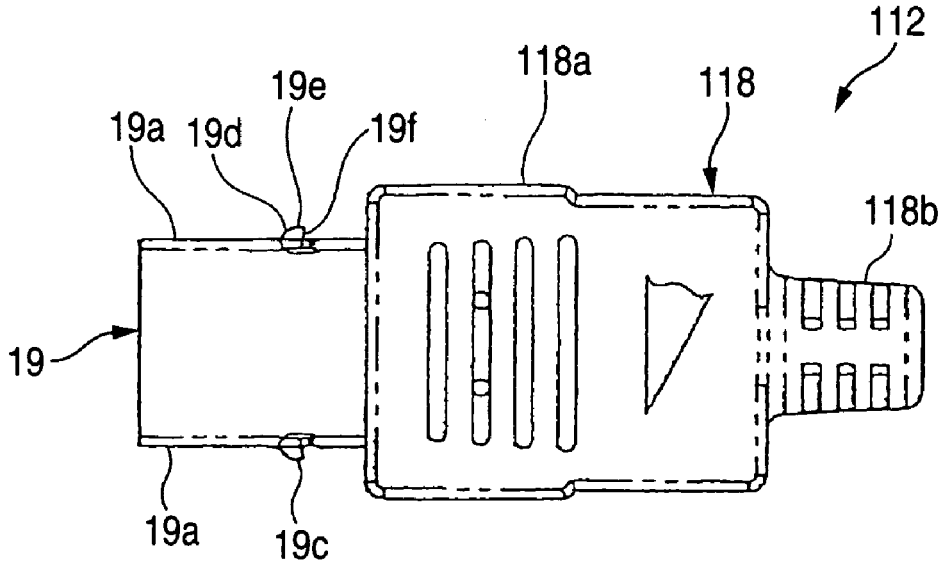
FIG. 15 is a plan view of the plug of FIG. 13.
Figure 16:
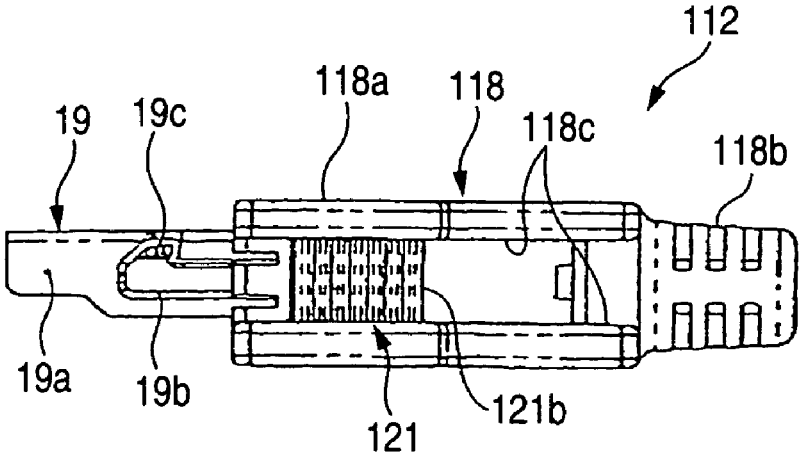
FIG. 16 is a side elevational view of the plug of FIG. 13.

FIG. 13 is a perspective view of a plug of the lock mechanism-equipped USB connector of the second embodiment disposed upside down, FIG. 14 is a front-elevational view of the plug of FIG. 13, FIG. 15 is a plan view of the plug of FIG. 13, and FIG. 16 is a side-elevational view of the plug of FIG. 13.

Figure 17:
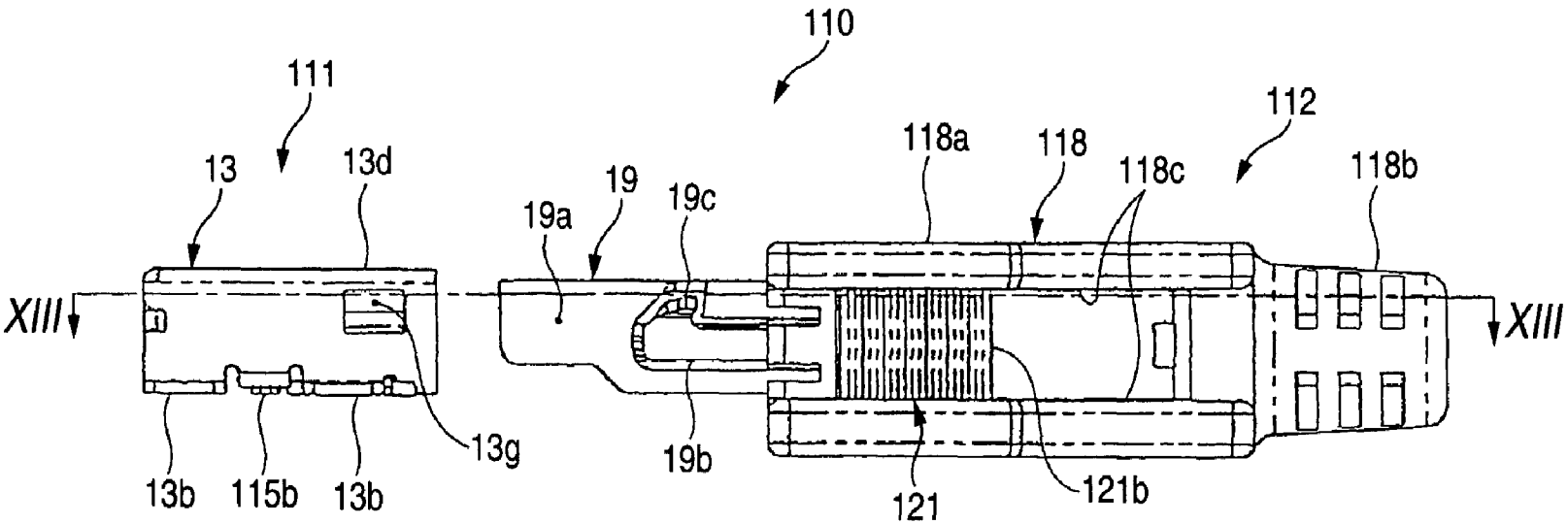
FIG. 17 is a side-elevational view of the lock mechanism-equipped USB connector of the second embodiment, showing a condition immediately before the plug is inserted into the receptacle.
Figure 18:
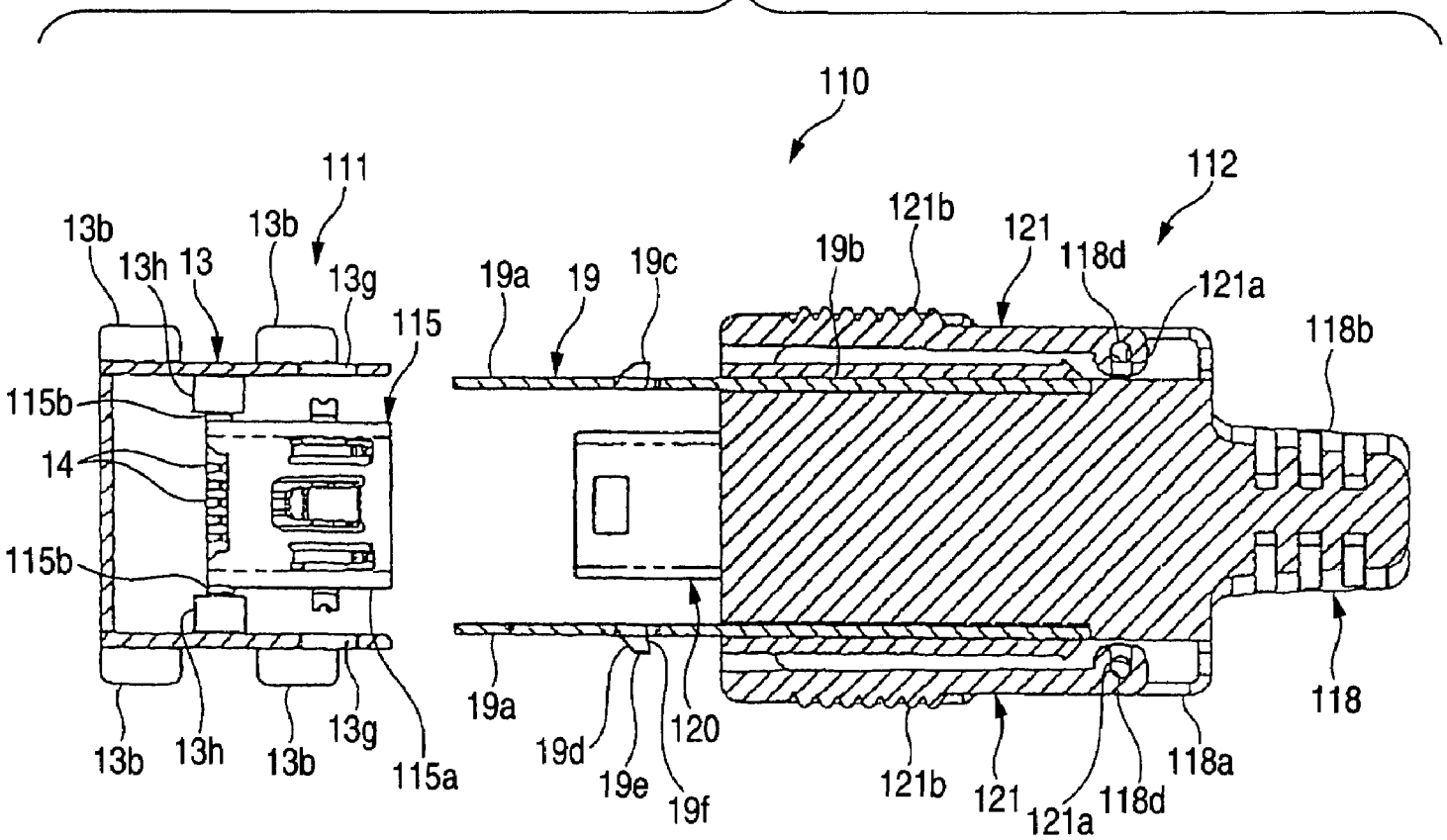
FIG. 18 is a cross-sectional view taken along the line XVIII—XVIII of FIG. 17.
Figure 19:
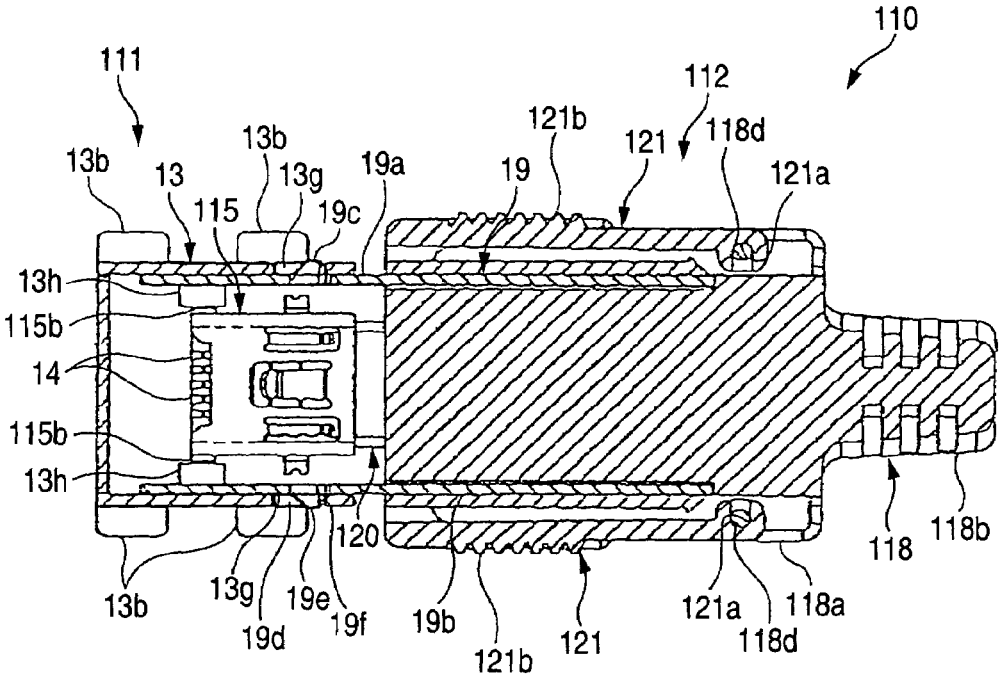
FIG. 19 is a cross-sectional view taken along the line XVIII—XVIII of FIG. 17, showing a condition in which retaining portions of the plug are engaged in engagement portions of the receptacle.
Figure 20:
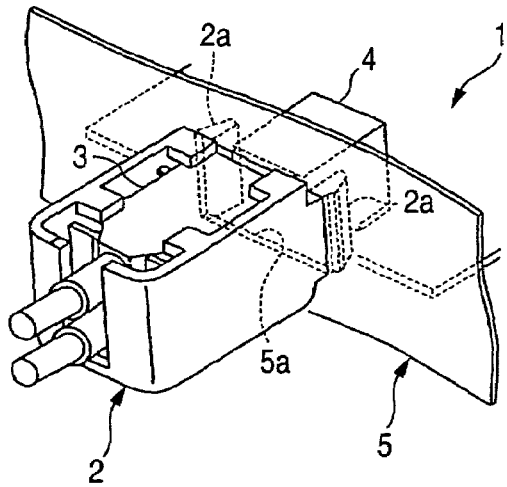
FIG. 20 is a perspective view a related withdrawal prevention mechanism in which a cap and a box-like body are engaged with each other, thereby preventing the withdrawal of a plug.

FIG. 17 is a side-elevational view of the lock mechanism-equipped USB connector of the invention, showing a condition immediately before the plug is inserted into the receptacle, FIG. 18 is a cross-sectional view taken along the line XVIII—XVIII of FIG. 17, and FIG. 19 is a cross-sectional view taken along the line XVIII—XVIII of FIG. 17, but showing a condition in which retaining portions of the plug are engaged in engagement portions of the receptacle.

In the following description, those portions which have already been described with respect to the lock mechanism-equipped USB connector of the first embodiment (shown in FIGS. 1 to 9) will be designated by identical reference numerals, respectively, and explanation thereof will be made briefly or omitted.

As shown in FIGS. 17 to 19, the lock mechanism-equipped USB connector 110 of the second embodiment includes the receptacle 111 and the plug 112. As shown in FIGS. 10 to 12, the receptacle 111 includes a receptacle shell 13, an inner receptacle shell 115 provided within the receptacle shell 13, a terminal holding portion 116 fixedly mounted within the inner receptacle shell 115, and a plurality of receptacle terminals 14 held in the terminal holding portion 116. The receptacle shell 13, as well as the inner receptacle shell 115, is formed by pressing an electrically-conductive thin sheet (made of copper, a copper alloy, an aluminum alloy or the like) into a generally rectangular tubular shape.

As shown in FIG. 11 the inner receptacle shell 115 is a generally rectangular tubular member having a fitting hole 16 open forwardly in a connector fitting direction, and leg portions 115*b* extend laterally from opposite side walls 115*a* of the inner receptacle shell 115, respectively. The leg portions 115*b* are electrically connected by welding or the like respectively to fixing portions 13*h* of the receptacle shell 13 bent to be disposed within this receptacle shell 13. Thus, the inner receptacle shell 115 is disposed within the receptacle shell 13.

As shown in FIGS. 10 and 11, the terminal holding portion 116 serves to hold the receptacle terminals 14 in a predetermined position, and is made of an insulative synthetic resin such as propylene. The terminal holding portion 116 includes a thickened rear portion 116*b* (that is, a rear portion in the connector fitting direction) which is fitted in the inner receptacle shell 115 to be fixed thereto. The terminal holding portion 116 also includes a thinned front portion 116*a* (that is, a front portion in the connector fitting direction) which projects forwardly in the connector fitting direction, and is disposed within the fitting hole 16. A plurality of terminal through holes are formed through the terminal holding portion 116, and communicate with the fitting hole 16, and the receptacle terminals 14 are passed respectively through these through holes, and are fixed thereto.

As shown in FIGS. 13 to 16, the plug 112 includes a housing 118 made of a resin, a plug shell 19 held in the housing 118, plug terminals 20 provided within the plug shell 19, and a pair of pressing members 121 which are one example of an engagement release mechanism.

The housing 118 includes a housing body 118*a*, and a tube portion 118*b* for passing wires (not shown) therethrough, and this housing 118 is molded into an integral construction, using an insulative synthetic resin. A pair of lock release prevention ribs 118*c* are formed on and project laterally from upper and lower portions of each of opposite side surfaces of the housing body 118*a*, respectively. A groove is formed between each pair of lock release prevention ribs 118*c*, and the pressing members 121 are received in these grooves, respectively. The plug shell 19 is fixed to the housing body 118*a*, and projects forwardly from the housing body 118*a* in the connector fitting direction.

As shown in FIGS. 13 and 14, the plug shell 19 is formed by pressing an electrically conductive thin sheet (made of copper, a copper alloy, an aluminum alloy or the like) into a generally U-shape. The outer size of the plug shell 19 is slightly smaller than the inner size of the receptacle shell 13 so that the plug shell 19 can be fitted into the receptacle shell 13.

As shown in FIGS. 13 to 16, a pair of resilient piece portions 19*b* are formed respectively at opposite side walls 19*a* of the plug shell 19, and extend forwardly in the connector fitting direction. Each resilient piece portion 19*b* is continuous at its proximal end with the plug shell 19, and is formed into a narrow elongate shape, and extends in the longitudinal direction of the plug shell 19, and is resilient.

A claw 19*c* (serving as the retaining portion) is formed at a distal end of each resilient piece portion 19*b*, and projects outwardly from the side wail 19*a*. The resilient piece portion 19*b* can be resiliently deformed, and therefore the claw 19*c* is retractably projected from the side wall 19*a* so as to be engaged in a corresponding hole 13*g* in the receptacle shell 13.

As shown in FIG. 151 each claw 19*c* includes a slanting surface 19*d* gradually approaching the side wall 19*a* forwardly in the connector fitting direction, an interconnecting surface 19*e* extending from the slanting surface 19*d* in the connector fitting direction, and a retaining surface 19*f* substantially perpendicularly intersecting the interconnecting surface 19*e*.

As shown in FIGS. 13 and 14, the plug terminals 20 are adapted to be contacted respectively with the receptacle terminals 14 to be electrically connected thereto. The plug terminals 20 are held in a terminal holding portion 22 which is provided in the housing body 118*a*, and projects forwardly from this housing body 118*a* in the connector fitting direction. The outer periphery (i.e., four side surfaces except front and rear surfaces in the connector fitting direction) of the terminal holding portion 22 is surrounded by an inner plug shell 120 which is formed by pressing an electrically-conductive thin sheet (made of copper, a copper alloy, an aluminum alloy or the like) into a generally rectangular tubular shape). An outer size of the inner plug shell 120 is slightly smaller than the inner size of the inner receptacle shell 115 so that the inner plug shell 120 can be fitted into the inner receptacle shell 115.

As shown in FIGS. 13, 14, 16, 18 and 19, the pressing members 121 (which are one example of the engagement release mechanism) are designed to press the respective resilient piece portions 19*b* so as to cancel the engagement of the claws 19*c* with the respective holes 13*g*. Each of the pair of pressing members 121 is molded of an insulative synthetic resin by injection molding. A support portion 121*a* of a generally U-shape is formed at one end of the pressing member 121, and an outer surface of the pressing member 121 is roughened to provide a press operating portion 121*b* (see FIGS. 18 and 19).

The generally U-shaped support portions 121*a* of the pressing members 121 are fitted respectively on support pins 118*d* formed on the housing body 118*a*, and the pressing members 121 are mounted respectively in the grooves, formed respectively in the opposite side surfaces of the housing body 118*a*, so as to be pivotally moved about the respective support pins 118*d*. The press operating portion 121*b* of each pressing member 121 is disposed flush with or slightly inwardly of the corresponding lock release prevention ribs 118*c* so that the press operating portion 121*b* will not be inadvertently pressed so as to prevent the engagement of the claw 19*c* with the hole 13*g* from being canceled.

When the press operating portions 121*b* are pressed, the pressing members 121 are pivotally moved about the respective support pins 118*d* toward each other to press the resilient piece portions 19*b*, respectively, thereby releasing the engagement of the claws 19*c* with the respective holes 13*g*.

The operation of the lock mechanism-equipped USB connector 110 of the second embodiment will be described.

In FIGS. 17 to 19, when the plug shell 19 of the plug 112 is fitted into the receptacle shell 13 of the receptacle 111, and the two are moved toward each other, first, the inner plug shell 120 is fitted into the inner receptacle shell 115. Then, an inner edge of the front end of the receptacle shell 13 is brought into abutting engagement with the slanting surfaces 19*d* of the claws 19*c*. When the plug 12 is further inserted, the resilient piece portions 19*b* are resiliently deformed toward the inside of the plug shell 19, so that the claws 19*c* are retracted into the plug shell 19.

Each of the claws 19*c* advances with its interconnecting surface 19*e* held in sliding contact with the inner surface of the receptacle shell 13, and reaches a position where the claw 19*c* is opposed to the corresponding hole 13*g*. Each resilient piece portion 19*b* is resiliently restored into its original condition, and the claw 11*c* is engaged in the hole 13*g*, with the retaining surface 19*f* held against the edge of the hole 13*g*, so that the receptacle 11 and the plug 12 are positively engaged with each other (see FIG. 19).

At this time, resilient contact portions 14*a* of the receptacle terminals 14 contact electrical contact portions of the plug terminals 20, respectively, and therefore are electrically connected thereto. The receptacle shell (outer shell) 13 and the plug shell (outer shell) 19 are disposed in a fitted condition, and also the inner receptacle shell (inner shell) 115 and the inner plug shell (inner shell) 120 are disposed in a fitted condition. Namely, in the lock mechanism-equipped USB connector 110, the outer shells are fitted together, and also the inner shells are fitted together, thus achieving a double fitted condition, and further the claws 19*c* are engaged in the holes 13*g*, respectively. Therefore, even when an external force, such as a twisting force and a connector-withdrawing force, is applied to the lock mechanism equipped USB connector 110, it will not adversely affect the electrical contact between the receptacle terminals 14 and the plug terminals 20. And besides, the receptacle terminals 14 are surrounded by the inner receptacle shell 115 and the receptacle shell 13, and are electromagnetically shielded in a double manner, while the plug terminals 20 are surrounded by the plug shell 19 and the inner plug shell 120, and are electrically shielded in a double manner. Therefore, the terminals are positively protected from disturbance such as electromagnetic noises.

When the plug 112 is withdrawn from the receptacle 1111 the press operating portions 121*b* of the pair of pressing members 121 are pressed toward each other by the fingers or others, and by doing so, the pressing members 121 are pivotally moved about the respective support pins 118*d* toward each other. As a result, the resilient piece portions 19*b* are pressed to be resiliently deformed inwardly, so that the engagement of the claws 19*c* with the respective holes 13*g* is canceled. Then, the plug 112 is pulled in the direction opposite to the direction of fitting of the lock mechanism-equipped USB connector 110, and by doing so, the plug 112 is moved apart from the receptacle 111, so that the connected condition is canceled.

In the lock mechanism-equipped USE connectors of the above embodiments, although the retaining portions are provided at the plug shell, while the engagement portions are provided at the receptacle shell, the invention is not limited to this construction, and there can be provided a construction in which retaining portions are provided at the receptacle shell, while engagement portions are provided at the plug shell.

As described above, in the lock mechanism-equipped USB connectors of the present invention, the retaining portion is provided at the plug shell, and the engagement portion is provided at the receptacle shell, and when the plug is inserted into the receptacle, the retaining portion is engaged with the engagement portion. Therefore, the plug and the receptacle are engaged with each other without looseness, and even when vibration or an external force acts on the connector, the plug is prevented from being withdrawn from the receptacle, thus ensuring the electrical connection regardless of the environment in which the connector is used.

Therefore, a computer can be mounted on a vehicle. And besides, the connector can be used in a medical equipment, a monetary equipment or the like requiring severe reliability.

The retaining portion is formed integrally with the plug shells and the engagement portion is formed integrally with the receptacle, and therefore the retaining mechanism can be formed into a small size, and this construction can sufficiently meet a demand for a small-size design of the equipment.

And besides, by inserting the plug into the receptacle, the retaining portion is brought into engagement with the engagement portion, and by moving the engagement release mechanism from the engaging position to the engagement releasing position, the engagement release mechanism presses the retaining portion, thereby releasing the engagement of the retaining portion with the engagement portion. Therefore, the plug and the receptacle can be quite easily engaged with each other, and also this engagement can be quite easily released, thus greatly enhancing the operability.

The retaining portion is the resilient piece portion formed at the wall portion of the plug shell, and the engagement portion is the hole formed in the receptacle shell, with this construction, the plug and the receptacle can be positively and easily engaged with and disengaged from each other by the small device.

The receptacle terminals are received within the inner receptacle shell provided within the receptacle shell, and the plug terminals are received within the inner plug shell provided within the plug shell, and therefore the receptacle terminals as well as the plug terminals are protected by the double-shell structure, and the connection of high reliability can be achieved. When each shell is made of an electrically-conductive material, the terminals can be electromagnetically shielded by the double-shell structure, and the reliability of protection against external noises can be enhanced.

And besides, the receptacle and the plug are fitted and connected together in such a double manner that the receptacle shell and the plug shell (which are the outer shells) are fitted together while the inner receptacle shell and the inner plug shell (which are the inner shells) are fitted together. Therefore, even when an external force, such as a twisting force, is applied to the lock mechanism-equipped USB connector, the connected condition will not be adversely affected by it, and therefore can be properly maintained.

The engagement release mechanism is either the slide member which is fitted on the plug shell so as to slide in the direction of fitting of the plug into the receptacle, and is movable between the engagement releasing position where the slide member presses the retaining portion to hold the retaining portion within the plug shell and the engagement releasing position where the slide member allows the retaining portion to project from the plug shell, or the pressing member which is mounted on the plug shell so as to move in the direction generally perpendicular to the direction of fitting of the plug into the receptacle, and is movable between the engagement releasing position where the pressing member presses the retaining portion to hold the retaining portion within the plug shell and the engagement releasing position where the pressing member allows the retaining portion to project from the plug shell. Therefore, merely by effecting either the simple operation for moving the slide member from the engaging position to the engagement releasing position or the simple operation for moving the pressing member from the engaging position to the engagement releasing position, the engagement of the retaining portion with the engagement portion can be easily canceled, and the operability for connection and disconnection of the lock mechanism-equipped USB connector can be greatly enhanced.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2003-162386 filed on Jun. 6, 2003 and Japan Patent Application No. 2002-190670 filed on Jun. 28, 2002, the contents of which are incorporated herein for reference.

What is claimed is:

1. A USB connector, comprising:

a receptacle which includes a receptacle shell, and a receptacle terminal provided in the receptacle shell;

a plug which includes a plug shell for fitting into the receptacle shell, and a plug terminal provided in the plug shell; and an engagement release member which is provided on the plug shell so as to be movable between an engagement releasing position and an engagement position, wherein when the plug is fitted into the receptacle, the plug terminal is electrically connected to the receptacle terminal;

wherein the plug shell has a flexible arm with a retaining portion thereon;

wherein the receptacle shell has an engagement portion which is engaged with the retaining portion when the plug is fitted into the receptacle;

wherein the engagement release member maintains an engagement of the retaining portion with the engagement portion at the engagement position;

wherein the engagement release member releases the engagement of the retaining portion with the engagement portion at the engagement releasing position by deflecting said flexible arm;

wherein the engagement release member has an urging portion which urges the engagement release member with respect to the plug shell so as to move the engagement release member to the engagement position; and wherein when the plug is released from the receptacle, the engagement release member moves to the engagement releasing position against an urging forth by the urging portion.

2. The USB connector as set forth in claim 1, wherein the engagement release member presses the flexible arm to release the engagement of the retaining portion with the engagement portion at the engagement releasing position; and wherein the engagement release member allows the retaining portion to project from the plug shell at the engagement position.

3. The USB connector as set forth in claim 1, wherein the retaining portion has a claw formed at a distal end of the flexible arm; and wherein the engagement portion is a hole formed in the receptacle shell.

4. The USB connector as set forth in claim 1, wherein the receptacle terminal is contained in an inner receptacle shell provided in the receptacle shell; and wherein the plug terminals is contained in an inner plug shell provided in the plug shell.

5. The USB connector as set forth in claim 1, wherein the engagement release member includes a slide member which is provided on the plug shell so as to slide in a fitting direction of the plug into the receptacle; and wherein the slide member is movable between the engagement releasing position where the slide member presses the retaining portion to hold flexible arm portion within the plug shell and the engagement position where the slide member allows the retaining portion to project from the plug shell through the engagement portion.

6. The USB connector as set forth in claim 1, wherein the engagement release member includes a pressing member which is provided on the plug shell so as to move in a direction substantially perpendicular to a fitting direction of the plug into the receptacle; and wherein the pressing member is movable between the engagement releasing position where the pressing member presses the retaining portion to hold the retaining portion within the plug shell and the engagement position where the pressing member allows the retaining portion to project from the plug shell through the engagement portion.

7. The USB connector as set forth in claim 1, wherein a movement direction of the engagement release member to the engagement releasing position is substantially same as a releasing direction of the plug from the receptacle.

* * * * *